US008807675B2

(12) United States Patent
Shindo

(10) Patent No.: US 8,807,675 B2
(45) Date of Patent: Aug. 19, 2014

(54) LIQUID DROPLET JETTING APPARATUS

(75) Inventor: Tatsuya Shindo, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 127 days.

(21) Appl. No.: 13/358,801

(22) Filed: Jan. 26, 2012

(65) Prior Publication Data

US 2012/0194581 A1 Aug. 2, 2012

(30) Foreign Application Priority Data

Jan. 31, 2011 (JP) ..... 2011-017865

(51) Int. Cl.
*B41J 2/195* (2006.01)

(52) U.S. Cl.
USPC ..... 347/7

(58) Field of Classification Search
USPC ..... 347/7, 23, 36, 86; 400/124.01
See application file for complete search history.

(56) References Cited

U.S. PATENT DOCUMENTS

| | | | | |
|---|---|---|---|---|
| 5,172,140 | A * | 12/1992 | Hirabayashi et al. | 347/36 |
| 5,745,134 | A | 4/1998 | Hirabayashi et al. | |
| 6,102,517 | A * | 8/2000 | Kobayashi et al. | 347/23 |
| 6,203,138 | B1 | 3/2001 | Hirabayashi et al. | |
| 2004/0179882 | A1* | 9/2004 | Jakubowski et al. | 400/124.01 |
| 2004/0223027 | A1* | 11/2004 | Shinkawa et al. | 347/23 |
| 2006/0061620 | A1* | 3/2006 | Tani et al. | 347/36 |
| 2007/0081057 | A1* | 4/2007 | Kim et al. | 347/86 |

FOREIGN PATENT DOCUMENTS

| | | |
|---|---|---|
| JP | 4-045953 | 2/1992 |
| JP | 5-270007 | 10/1993 |
| JP | 8-104014 | 4/1996 |
| JP | 2002-283588 | 10/2002 |
| JP | 2006-095820 | 4/2006 |

* cited by examiner

*Primary Examiner* — Manish S Shah
*Assistant Examiner* — Yaovi Ameh
(74) *Attorney, Agent, or Firm* — Frommer Lawrence & Haug LLP

(57) ABSTRACT

A liquid droplet jetting apparatus includes: a liquid droplet jetting head; a liquid kind detecting section detecting whether a liquid, used in the liquid droplet jetting head, is a first liquid having a conductivity of not less than a predetermined value or a second liquid having a conductivity of less than the predetermined value; a discharge mechanism discharging the liquid inside the liquid droplet jetting head therefrom; a waste liquid recovery device recovering the liquid discharged by the discharge mechanism, and including: a waste liquid case, an absorbing body accommodated in the waste liquid case, and a waste liquid detection mechanism measuring an electric current value in the absorbing body and thereby detecting whether or not the liquid arrives at a full-liquid detection position of the absorbing body; and a waste liquid absorb amount estimating section estimating an amount of the waste liquid absorbed in the absorbing body.

12 Claims, 8 Drawing Sheets

LIQUID DROPLET JETTING APPARATUS

CROSS REFERENCE TO RELATED APPLICATION

The present application claims priority from Japanese Patent Application No. 2011-017865 filed on Jan. 31, 2011 the disclosure of which is incorporated herein by reference in its entirety.

BACKGROUND OF THE INVENTION

1. Field of the Invention

The present invention relates to a liquid droplet jetting apparatus which jets a liquid droplet of a liquid from a liquid droplet jetting head.

2. Description of the Related Art

In conventional liquid droplet jetting apparatuses for jetting liquid droplets, there are many liquid droplet jetting apparatuses each of which is provided with a waste liquid recovery device recovering an unnecessary liquid (hereinafter referred to also as "waste liquid") discharged for example during maintenance for the liquid droplet jetting head. Each of the waste liquid recovery devices of general type has a waste liquid case and an absorbing body (absorbing member) which is formed of a porous material, which is accommodated in the waste liquid case and which absorbs the waste liquid.

Among such waste liquid recovery devices of the general type, there is known a waste liquid recovery device configured to be capable of detecting whether or not the waste liquid is absorbed into the absorbing body up to a full liquid state, in order to prevent the waste liquid from overflowing from the waste liquid case. For example, Japanese Patent Application laid-open No. H08-104014 and Japanese Patent Application laid-open No. 2002-283588 each disclose a technique in which a pair of electrodes is provided on an absorbing body at a predetermined full-liquid detection position thereof; and whether or not the liquid arrives at (reaches) the full-liquid detection position is directly detected from the conduction state between the electrodes when the voltage is applied. On the other hand, U.S. Pat. No. 5,172,140, U.S. Pat. No. 5,745,134 and U.S. Pat. No. 6,203,138 (corresponding to Japanese Patent Application laid-open No. H04-45953) and Japanese Patent Application laid-open No. 2006-95820 each disclose a technique in which an amount of the waste liquid absorbed in the absorbing body is estimated from an amount of the liquid discharged when purge, flushing, etc. is/are performed for a liquid droplet jetting head and from the number of time of the purge, flushing, etc.; and the full liquid state of the absorbing body is judged based on the presumption.

In a case that the full liquid state is detected from the conduction state between the electrodes as in Japanese Patent Application laid-open No. H08-104014 and Japanese Patent Application laid-open No. 2002-283588, the detection cannot be performed in some cases if the conductivity of the liquid is low. For example, in such a case that a liquid having a conductivity considerably lower than an assumed or predetermined conductivity is used, the full liquid state of the absorbing body cannot be detected and thus there is a fear that the waste liquid might eventually overflow.

On the other hand, in a case that the amount of the waste liquid is estimated as in U.S. Pat. No. 5,172,140, U.S. Pat. No. 5,745,134 and U.S. Pat. No. 6,203,138 (corresponding to Japanese Patent Application laid-open No. H04-45953) and Japanese Patent Application laid-open No. 2006-95820, it is possible to make judgment regarding the full liquid state regardless of the conductivity of the liquid. It is difficult, however, to correctly or accurately estimate the ratio of evaporation of the liquid due to the usage environment such as ambient temperature, humidity, etc., and a flow passage for the liquid, etc., and it is not possible to detect the full liquid state of the absorbing body such as a foam highly precisely. Therefore, it is necessary to set a large margin for the estimated value so as to prevent the waste liquid from overflowing, and there is a such a problem that a detection of "full liquid state" is given even if any non-absorb portion is remained in the absorbing body.

SUMMARY OF THE INVENTION

In view of the above situation, an object of the present teaching is to provide a liquid droplet jetting apparatus capable of detecting the full liquid state of the absorbing body highly precisely and of detecting the full liquid state of absorbing body without any overlooking or detection failure even if a liquid which cannot be detected by a waste liquid detection mechanism is used.

According to an aspect of the present teaching, there is provided a liquid droplet jetting apparatus which jets a liquid droplet of a liquid, including: a liquid droplet jetting head which has a nozzle formed therein and which jets the liquid droplet of the liquid from the nozzle; a liquid kind detecting section which detects whether the liquid, used in the liquid droplet jetting head, is a first liquid having a conductivity of not less than a predetermined value or a second liquid having a conductivity of less than the predetermined value; a discharge mechanism which discharges the liquid inside the liquid droplet jetting head from the liquid droplet jetting head; a waste liquid recovery device which recovers the liquid discharged by the discharge mechanism, the waste liquid recovery device including: a waste liquid case; an absorbing body accommodated in the waste liquid case; and a waste liquid detection mechanism which measures an electric current value in the absorbing body at a predetermined full-liquid detection position when a predetermined voltage is applied, and which detects whether or not the liquid arrives at the full-liquid detection position of the absorbing body based on the measured electric current value; a waste liquid absorb amount estimating section which estimates an amount of the waste liquid, absorbed in the absorbing body, based on a value of an estimated amount of the waste liquid generated by one discharge operation of the discharge mechanism and the number of times of the discharge operations performed by the discharge mechanism; and a full liquid judging section which judges whether or not the absorbing body is in a full liquid state; wherein the full liquid judging section judges whether or not the absorbing body is in the full liquid state based on a detection result of the waste liquid detection mechanism, under a condition that the liquid kind detecting section detects that the liquid is the first liquid; and the full liquid judging section judges whether or not the absorbing body is in the full liquid state based on the amount of the waste liquid estimated by the waste liquid absorb amount estimating section, under a condition that the liquid kind detecting section detects that the liquid is the second liquid.

According to the aspect of the present teaching, in a case that the liquid which is absorbed by the absorbing body is the first liquid having the conductivity of not less than the value which can be detected by the waste liquid detection mechanism, it is judged whether or not the absorbing body is in the full liquid state based on the detection of the conductivity by the waste liquid detection mechanism. On the other hand, in a case that the liquid is the second liquid, judgment is made concerning the full liquid state based on the estimated waste liquid amount, by the waste liquid absorb amount estimating section, which is estimated based on the value of the estimated amount of the waste liquid generated by one time of the discharge operation of the discharge mechanism and the number of times of the discharge operation performed by the discharge mechanism. By doing so, in a case that the liquid used in the liquid droplet jetting head is the first liquid, the full liquid state can be detected highly precisely by the waste liquid detection mechanism; and also in a case that the liquid is the second liquid, it is possible to assuredly detect the full liquid state by the waste liquid absorb amount estimating section. Note that the term "full liquid state" in the present teaching encompasses not only a state that the absorbing body absorbs the liquid to the limit thereof, but also a state that a slight non-absorb portion or part remains in the absorbing body immediately before the absorbing body reaches to such a complete full liquid state as described above.

DESCRIPTION OF THE PREFERRED EMBODIMENTS

Next, an explanation will be given about an embodiment of the present teaching. The embodiment is an example in which the present teaching is applied to an ink jet printer as the liquid droplet jetting apparatus provided with an ink-jet head 3 which jets liquid droplets of an ink toward a recording paper (recording paper sheet) P so as to record an image, letter, etc. on the recording paper sheet P.

First, the schematic construction of an ink-jet printer 1 of the embodiment will be explained with reference to FIGS. 1 to 3.

Figure 1:
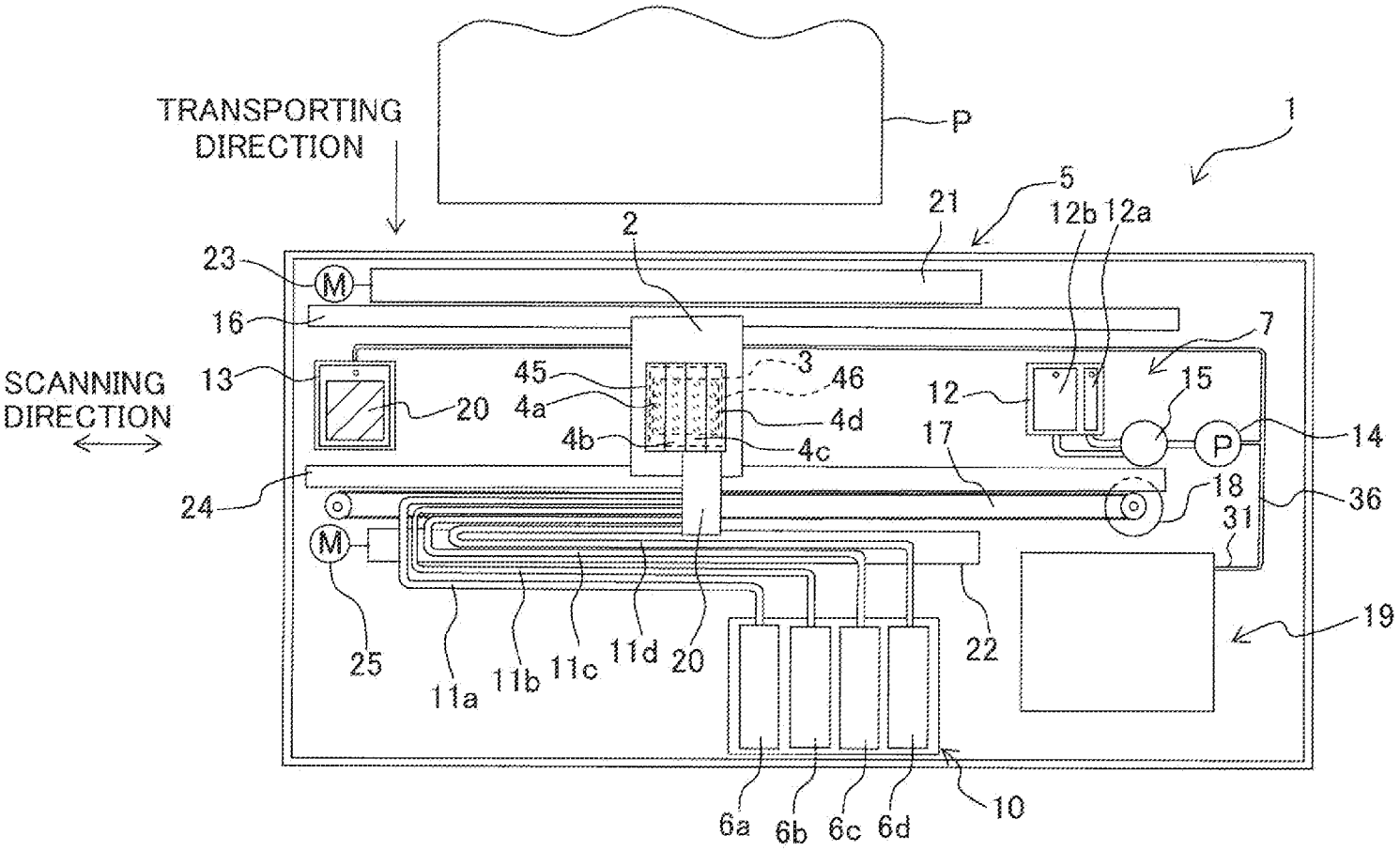
FIG. 1 is a schematic plan view of an ink-jet printer of an embodiment of the present teaching.
Figure 3:
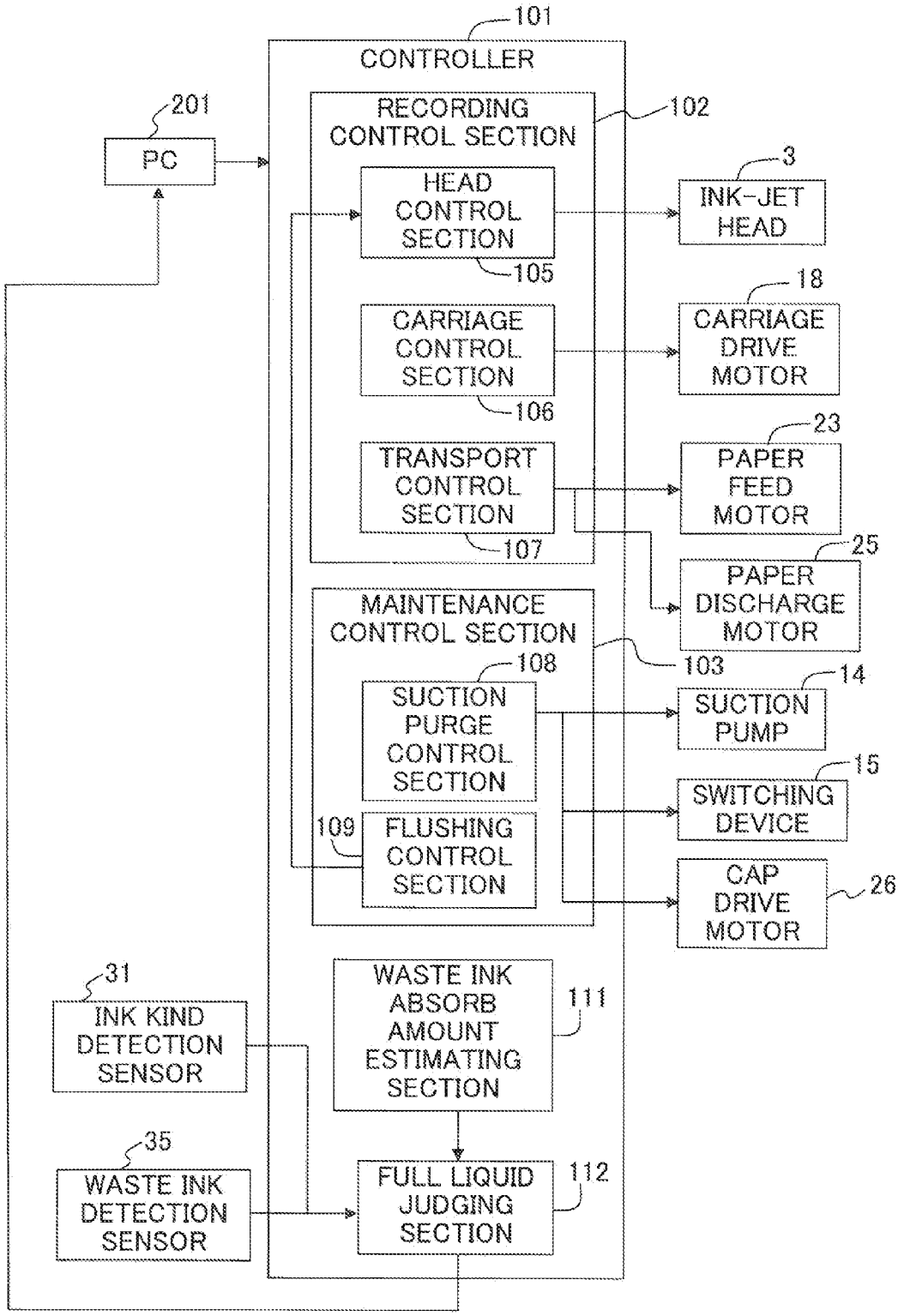
FIG. 3 is a block diagram showing a control system of the ink-jet printer.

As shown in FIGS. 1 and 3, the ink-jet printer 1 is provided with a carriage 2 configured to be reciprocatably movable in a predetermined scanning direction (left/right direction in FIG. 1); an ink-jet head 3 provided on the carriage 2; a transporting mechanism 5 which transports the recording paper sheet P as the recording medium in a transporting direction crossing (here, orthogonal to) the scanning direction; a maintenance unit 7 which performs various maintenance operations in relation to the recovery and maintenance for the liquid droplet jetting performance of the ink-jet head 3; a waste ink recovery device 19 which recovers a waste ink discharged from the ink jet head 3 during the maintenance, etc.; a controller 101 (see FIG. 3) which is in charge of the control of the entire ink-jet printer 1; and the like.

The carriage 2 is configured to be reciprocatably movable along two guide shafts 16, 24 extending in parallel with the scanning direction (left/right direction in FIG. 1). Further, an endless belt 17 wound around pulleys is connected to the carriage 2. The carriage 2 is configured to move in the scanning direction in company with the traveling of the endless belt 17 when the endless belt 17 is driven to travel by a carriage drive motor 18.

The ink-jet head 3 is provided on the carriage 2. The ink-jet head 3 is provided with a large number of nozzles 45 on the lower surface thereof (a surface beyond the sheet surface of FIG. 1; hereinafter referred to as "ink-jet surface"). In this embodiment, nozzles 45 corresponding to cyan, magenta, yellow and black inks respectively are aligned to form arrays each extending in the transporting direction. Note that in FIG. 1, each of the nozzles 45 is depicted to be fairly large for ease of understanding on the drawing, and the number of the nozzles 45 is depicted as fairly small. However, actually, a large number of nozzles 45 having a very small opening are formed in the ink-jet head 3. Sub-tanks 4*a* to 4*d* each supplying an ink to the nozzles 45 are provided at a position above or over the nozzles 45, and the cyan, magenta, yellow and black inks are stored in the four sub-tanks 4*a* to 4*d*, respectively, corresponding to the colors of the inks jetted from the nozzles 45 which are associated with the sub-tanks 4*a* to 4*d*, respectively. Further, the sub-tanks 4*a* to 4*d* are connected to ink cartridges 6*a* to 6*d*, via a tube joint 20 and flexible tubes 11*a* to 11*d*, respectively, connected to the tube joint 20 so that the colors of the inks stored in the sub-tanks 4*a* to 4*d* correspond to those stored in the cartridges 6*a* to 6*d*, respectively which are attached to an ink cartridge attachment section 10.

The transport mechanism 5 includes a paper feed roller 21 arranged on the upstream of the ink-jet head 3 in the transporting direction, and a paper discharge roller 22 arranged on the downstream of the ink-jet head 3 in the transporting direction. The paper feed roller 21 and the paper discharge roller 22 are rotated and driven by a paper feed motor 23 and a paper discharge motor 25, respectively, in a synchronized manner. The transport mechanism 5 transports the recording paper sheet P to the ink-jet head 3 by the paper feed roller 21 from a location that is the upper portion of FIG. 1 by a predetermined feeding amount, and discharges the recording paper sheet P, on which an image, a letter, etc. is/are recorded by the ink jet head 3, by the paper discharge roller 22 to a location that is the lower portion of FIG. 1.

The maintenance unit 7 is provided with a cap 12 which makes tight contact with the lower surface (ink-jet surface) of the ink-jet head 3 to cover the openings of the plurality of nozzles 45 therewith, and a suction pump 14 (suction mechanism) which is connected to the cap 12.

The cap 12 is configured to be movable in the up and down direction (vertical direction to the sheet surface of FIG. 1), and is driven by an appropriate cap driving mechanism including a cap drive motor 26 (see FIG. 3) so that the cap 12 is driven to make approach/separation with respect to the ink-jet surface of the ink-jet head 3. Further, the cap 12 includes a first cap portion 12*a* and a second cap portion 12*b* which are partitioned by a partition wall in the cap 12; when the cap 12 is brought in tight contact with the ink-jet surface of the ink-jet head 3 (when the cap 12 is in a capping state), the first cap portion 12*a* covers nozzles 45 (nozzles belonging to a nozzle array located on the rightmost side in FIG. 1), among the nozzles 45, which jet the black ink and the second cap portion 12*b* covers nozzles which jet the yellow, cyan and magenta inks respectively (nozzles belonging to three nozzle arrays located left side of the rightmost, black nozzle array in FIG. 1).

Further, a switching device 15, which performs switching the communication objective of the suction pump 14 (with which the suction pump 14 to be communicated) between the two cap portions that are the first and second cap portions 12*a*, 12*b*, is arranged between the cap 12 and the suction pump 14. When the cap 12 is in the capping state, suction (depressurization) in the interior of the first cap portion 12*a* and suction (depressurization) in the interior of the second cap portion 12*b* are performed individually (separately from each other), and dust, air bubble, viscous ink, etc. existing in the ink flow passage such as the nozzles 45 in the ink-jet head 3, etc. are sucked and discharged from the openings of the nozzle 45 together with the ink (suction purge). Namely, the suction purge for the nozzles 45 for the black ink and the suction purge for the nozzles 45 for the color inks (yellow, cyan and magenta inks) are performed individually from each other.

Furthermore, the ink-jet printer 1 of this embodiment is constructed to perform the flushing so that the ink is discharged by jetting the ink from each of the nozzles 45 of the ink jet head 3 at the appropriate timing, for the purpose of for example preventing the inside of the nozzles 45 from drying, during a period of time in which any printing is not performed on a recording paper sheet P. As shown in FIG. 1, a flushing receiving member 13 is provided at a position located on the side opposite to the maintenance unit 7 with a printing area, in which the recording paper sheet P is transported, being intervened between the flushing receiving member 13 and the maintenance unit 7. Note that a flushing foam 20 formed of a porous member (porous material) is accommodated inside the flushing receiving member 13. The ink-jet printer 1 performs the flushing after the ink jet head 3 is moved to a position at which the ink-jet head 3 faces or is opposed to the flushing receiving member 13. The ink discharged from the nozzles 45 in accordance with the flushing is received by the flushing receiving member 13.

As shown in FIG. 1, the cap 12, which receives the waste ink discharged from the nozzles 45 during the suction purge, is connected to the waste ink recovery device 19 via the suction pump 14. Further, the flushing receiving member 13 which receives the waste ink discharged from the nozzles 45 during the flushing is also connected to the waste ink recovery device 19. Furthermore, the waste inks generated during the suction purge and the flushing respectively are all sent to and recovered by the waste ink recovery device 19. Note that the suction pump 14 for performing the suction purge and an actuator 46 of the ink-jet head 3 which is operated while performing the flushing both correspond to the "discharge mechanism", of the present teaching, which causes the ink inside the ink-jet head 3 to be discharged from the ink-jet head 3.

Next, the waste ink recovery device 19 will be explained in detail, with reference to FIGS. 2A and 2B. The waste ink recovery device 19 includes a waste ink case 33 (waste liquid case) into which the waste ink inflows or enters, an absorbing body 34 accommodated in the waste ink case 33, and a waste ink detection sensor 35 (waste liquid detection mechanism) which detects whether or not the waste ink flowed into the waste ink case 33 arrives at a predetermined full liquid detection position (detection position A) of the absorbing body 34.

The waste ink case 33 is formed to have a rectangular parallelepiped box-shape, and a tube 36 communicating with the cap 12 and the flushing receiving member 13 is connected to a side surface 33*a* (side surface on the right side in FIGS. 2A, 2B) of the waste ink case 33.

The absorbing body 34 which is formed of a porous member and to have a rectangular parallelepiped shape is accommodated in the waste ink case 33. The waste ink flowing from the tube 36 into the waste ink case 33 falls along the inner side surface (inner side surface of the side surface 33*a*) of the waste ink case 33, and is absorbed by the absorbing body 34 from a corner portion 34*c* of the absorbing body 34, the corner portion 34*c* being defined by a side surface 34*a* (side surface facing the side surface 33*a* of the waste ink case 33) and a bottom surface 34*b* of the absorbing body 34. Namely, as shown in FIG. 2A in broken lines, the waste ink permeates or infiltrates in the absorbing body 34 radially from the corner portion 34*c* as the permeation/infiltration center.

The four color inks used in the embodiment are each a conductive liquid having a predetermined conductivity. Further, the waste ink detection sensor 35 provided for detecting the full liquid state of the absorbing body 34 detects whether or not the waste ink arrives at the detection position A of the absorbing body 34 by measuring the conductivity at the detection position A.

A detailed explanation will be given about the detection principle of the waste ink by the waste ink detection sensor 35. The waste ink detection sensor 35 has a pair of electrodes provided on the absorbing body 34 at the predetermined detection position A thereof; the waste ink detection sensor 35 measures a value of electric current generated when a minute voltage is applied between the pair of electrodes, and obtains the conductivity (reciprocal of the resistivity) from the measured value of the electric current. Further, the waste ink detection sensor 35 detects whether or not the waste ink arrives at the detection position A based on whether or not the conductivity exceeds a predetermined threshold value.

Figure 2A:
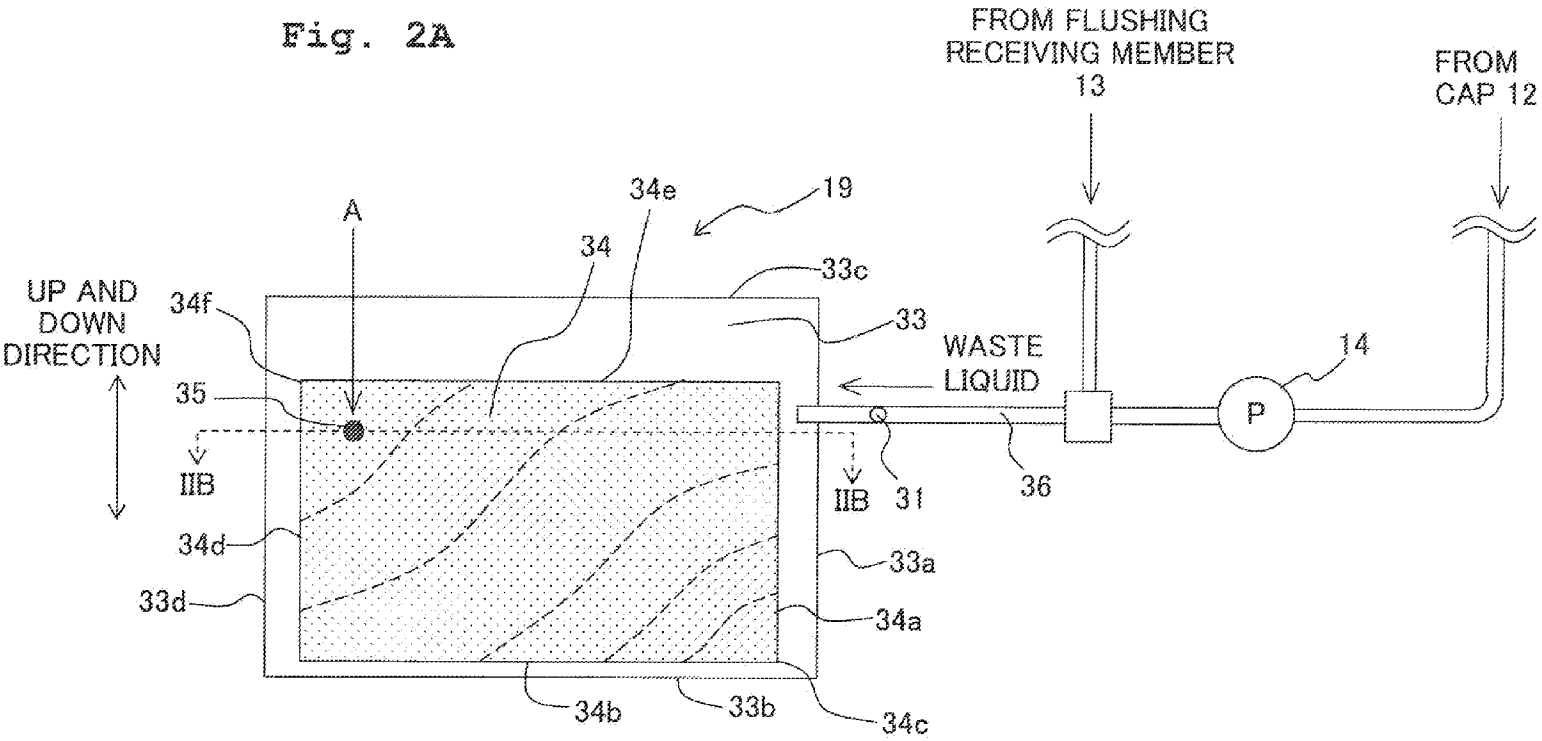
FIG. 2A is a side view showing a schematic construction of a waste ink recovery device.
Figure 2B:
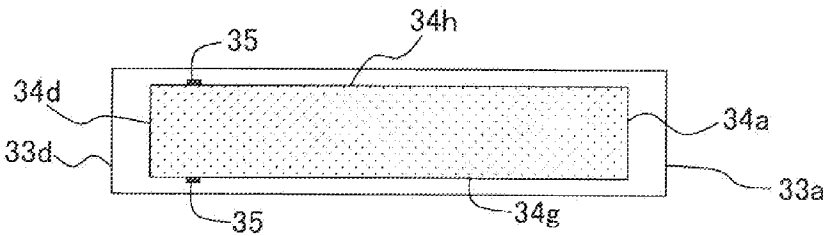
FIG. 2B is a cross-sectional view taken along a line IIB-IIB in FIG. 2A.

Further, in the embodiment, the waste ink inflowed into the waste ink case 33 permeates in the absorbing body 34 radially from the corner portion 34*c* of the absorbing body 34 as shown in FIG. 2A. Consequently, a corner portion 34*f* defined by another side surface 34*d* (side surface facing the side surface 34*a* of the absorbing body 34) and an upper surface 34*e* of the absorbing body 34, is assumed as a portion at which the waste ink arrives lastly. Accordingly, the waste ink detection sensor 35 has the pair of electrodes arranged in a pair of mutually facing side surfaces 34*g*, 34*h*, respectively, of the absorbing body 34 at the detection position A located in the vicinity of the corner portion 34*f*, so as to detect the full liquid state of the absorbing body 34.

Note that the detection position A may be set, for example, at the corner portion 34*f* of the absorbing body 34 that is a limit full liquid position at which the absorbing body 34 cannot absorb the waste ink any more in a state that the waste ink arrives at this detection position A. However, the detection position A may also be set at a position at which detection can be made when the absorbing body 34 is in a state nearly arriving at the limit full liquid state. For example, the detection position A may be set at a position located to be lower to some extent with respect to the corner portion 34*f* of the absorbing body 34 and to be toward the side surface 34*a* of the absorbing body 34 as shown in FIG. 2A, so that a small or slight non-absorbing portion exists in the absorbing body 34 even after the waste ink has arrived at the detection position A and that a small amount of the waste ink can be still absorbed in the absorbing body 34.

The waste ink detection sensor 35 detects the waste ink from the value of the electric current measured at the detection position A of the absorbing body 34. However, if any ink having a considerably low conductivity is used in the ink-jet head 3, the conductivity of the waste ink is also low, the measured value of electric current is also low, and thus there is a fear that it might be unable to detect the full liquid state of the absorbing body 34 by the waste ink detection sensor 35. In view of such a possibility, an ink kind detection sensor 31 (liquid kind detecting section), which detects whether or not the waste ink that is sent to the waste ink recovery device 19 is an ink capable of being detected by the waste ink detection sensor 35, is arranged in the tube 36 connecting the waste ink recovery device 19 together with the cap 12 and the flushing receiving member 13, as shown in FIG. 2A.

As the ink kind detection sensor 31, it is possible to use a sensor which measures a value of electric current in a case that a minute voltage is applied at a predetermined detection position, in a similar manner to the waste ink detection sensor 35. Specifically, a pair of electrodes is attached or adhered to the inner surface of the tube 36, and the electric current flowing between the electrodes is measured to obtain the conductivity. Further, by any chance, when the waste ink flowing to the waste ink recovery device 19 is detected by the ink kind detection sensor 31 to be an ink having a low conductivity which cannot be detected by the waste ink detection sensor 35, the amount of the waste ink absorbed in the absorbing body 34 is estimated and then the full liquid state of the absorbing body 34 is judged based on the estimated amount of the waste ink absorbed in the absorbing body 34, as will be described later on.

Further, it is necessary to detect the kind of the ink by the ink kind detection sensor 31 at a timing at which the waste ink assuredly flows in the tube 36. In view of this, the ink kind detection sensor 31 is arranged between the cap 12 and the waste ink recovery device 19 and then the ink kind detection sensor 31 detects the conductivity of the ink flowing from the cap 12 when the suction purge of the ink-jet head 3 is being performed, thereby making it possible to distinguish (discriminate) the kind of the ink. Note that in this case, the cap 12 which receives the ink discharged from the nozzles 45 during the suction purge corresponds to the "liquid receiving member" of the present teaching.

However, in the embodiment as described above, the cap 12 is partitioned into the first cap portion 12*a* for the black ink and the second cap portion 12*b* for the color inks, and the suction purge is performed individually for the nozzles 45 for the black ink and for the nozzles 45 for the color inks. Accordingly, during each of the suction purge for the nozzle 45 for the black ink and the suction purge for the nozzles 45 for the color inks, the ink kind detection sensor 31 detects whether or not the waste ink flowing in the tube 36 is an ink (first liquid) which has the conductivity of not less than the predetermined value and which can be detected by the waste ink detection sensor 35. Namely, the detection of the kind (conductivity) of the waste ink is performed for each of the black ink and the color inks.

Next, the control system of the ink-jet printer 1 will be explained with reference to the block diagram of FIG. 3. The controller 101 controls the ink-jet printer 1 based on an instruction or command from a PC 201 connected to the ink-jet printer 1. The controller 101 is provided as a microcomputer including, for example, a CPU (Central Processing Unit); a ROM (Read Only Memory) which stores a variety of kinds of programs, data, etc. for controlling the entire operation of the ink-jet printer 1; a RAM (Random Access Memory) which temporarily stores a data, etc. to be processed in the CPU, and the controller 101 performs a variety of kinds of controls as described below by executing the programs, stored in the ROM, by the CPU. Alternatively, the controller 101 may be a hardware-like unit, etc., constructed for example by combining a variety of kinds of circuits including an arithmetic circuit.

The controller 101 includes a recording control section 102 which performs recording of an image, a letter, etc., on a recording paper sheet P; and a maintenance control section 103 which performs control for the maintenance of the ink-jet head 3.

The recording control section 102 includes a head control section 105, a carriage control section 106, and a transport control section 107. The head control section 105 controls the actuator 46 which causes the ink in the ink-jet head 3 to be jetted; the carriage control section 106 controls the carriage drive motor 18 which moves the carriage 2 in the scanning direction; the transport control section 107 controls the paper feed motor 23 and the paper discharge motor 25 which drive the paper feed roller 21 and the paper discharge roller 22, respectively, transporting the recording paper sheet P. These control sections 105 to 107 cooperate with one another to move the carriage 2 in the scanning direction while transporting the recording paper sheet P, thereby recording an image, a letter, etc. on the recording paper sheet P.

The maintenance control section 103 is provided with a suction purge control section 108 which controls the suction purge executed by the suction pump 14, etc., and a flushing control section 109 which controls the flushing for the ink-jet head 3.

Further, the controller 101 is provided with a waste ink absorb amount estimating section 111 (waste liquid absorb amount estimating section) which estimates an amount of the waste ink absorbed in the absorbing body 34; and a full liquid judging section 112 which judges whether or not the absorbing body 34 is in the full liquid state.

The respective functions of the recording control section 102, the maintenance control section 103, the waste ink absorb amount estimating section 111 and the full liquid judging section 112 are realized, actually, by the operation of the microcomputer or the operation of the various circuits including an arithmetic circuit, as described above.

The waste ink absorb amount estimating section 111 presumes a total amount of the waste ink discharged from the ink-jet head 3 up to the current point of time after the start of usage of the ink-jet printer 1 or after the exchange of the absorbing body 34 of the waste ink recovery device 19, and estimates an amount of the waste ink absorbed in the absorbing body 34 based on the estimated total amount of the discharged waste ink. Namely, the detection of the full liquid state by the waste ink detection sensor 35 is performed in parallel with the presumption of the absorbed amount of the waste ink by the waste ink absorb amount estimating section 111 after start of usage of the ink-jet printer 1 or after exchange of the absorbing body 34 of the waste ink recovery device 19.

The waste ink recovered by the waste ink recovery device 19 is roughly grouped into a waste ink from the suction purge and a waste ink from the flushing. Here, the suction purge control section 108 stores a designed value (theoretical value) of an amount of the waste ink discharged from the ink-jet head 3 by one time of the suction purge operation, and counts the number of times (total number of times: frequency) of the suction purge performed. Further, the waste ink absorb amount estimating section 111 presumes the total amount of the waste ink discharged by the suction purge by multiplying the amount of the waste ink (theoretical value), discharged by one time of the suction purge, by the total number of times of the suction purge performed. Note that, naturally, in a case that the discharge amount is different depending on the kind of the ink (between the black and color inks) or in a case that suction purges of different strengths (suction forces) are selectively used depending on the kind of the ink, the theoretical value of the waste ink is set for each of the suction purges and the number of times is counted for each of the suction purges.

Further, the flushing control section 109 stores, with respect to one piece of the nozzles 45, a designed value (theoretical value) of an amount of the waste ink discharged from one piece of the nozzles 45 by one time of the flushing; and the flushing control section 109 counts the number of times (total number of times: frequency) of the flushing performed. Further, the waste ink absorb amount estimating section 111 presumes the total amount of the waste ink discharged by the flushing by multiplying the designed value (theoretical value) of the amount of the waste ink, discharged by one time of the flushing, by the total number of times of the flushing performed. In this case also, similarly to the suction purge, in a case that the discharge amount is different depending on the kind of the ink (between the black and color inks) or in a case that flushings of different strengths (pressures) are selectively used depending on the kind of the ink, the theoretical value of the waste ink is set for each of the flushings and the number of times is counted for each of the flushings.

Moreover, other than the suction purge and flushing as described above, the waste ink is discharged from the ink-jet head 3 when substituting the ink inside the ink-jet head 3 before the initial usage of the ink-jet printer 1, etc.; and the waste ink absorb amount estimating section 111 may presume the total amount of the waste ink by also adding the amount of the waste ink discharged at such an another timing different from the suction purge and the flushing.

Further, the waste ink absorb amount estimating section 111 presumes the amount of the waste ink absorbed in the absorbing body 34 by, for example, multiplying the total amount of the waste ink estimated as described above by a previously set evaporation rate, etc.

Figure 4:
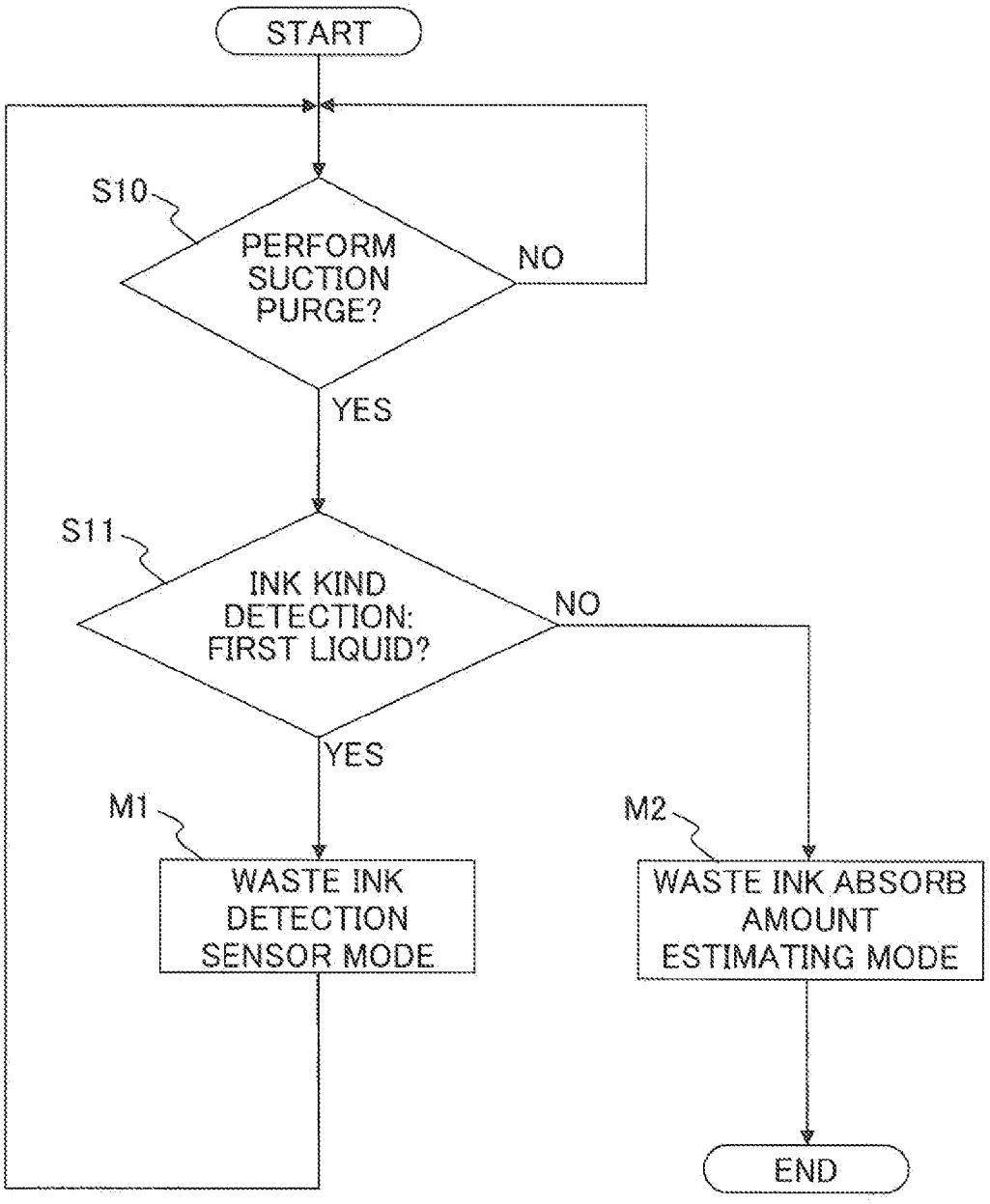
FIG. 4 is a flow chart showing a determining method for determining an operation mode of a full liquid judging section.

Next, an explanation will be given about the full liquid judging section 112 with reference to a flow chart of FIG. 4 showing a determining method for determining the operation mode of the full liquid judging section 112. The full liquid judging section 112 judges whether or not the absorbing body 34 of the waste ink recovery device 19 is in the full liquid state. Here, as described above, the detection of the full liquid state by the waste ink detection sensor 35 is performed in parallel with the presumption of the absorbed amount of the waste ink by the waste ink absorb amount estimating section 111 after the start of usage of the ink-jet printer 1 or after the exchange of the absorbing body 34 of the waste ink recovery device 19. Therefore, the full liquid judging section 112 is capable of, in a sense, directly detect the full liquid state of the absorbing body 34 from the detection result (measurement result of the electric current value) at the full liquid detection position A by the waste ink detection sensor 35 (waste ink detection sensor mode: M1), and is capable of estimating the full liquid state of the absorbing body 34 from the amount of the absorbed waste ink estimated by the waste ink absorb amount estimating section 111 (waste ink absorb amount estimating mode: M2).

However, as described above, the waste ink absorb amount estimating section 111 presumes the total amount of the waste ink discharged from the ink-jet head 3 based on the designed value (theoretical value), and thus it is inevitable that a deviation or error to some extent might occur with respect to the amount of the waste ink actually discharged from the ink-jet head 3. In addition, the evaporation rate for estimating the amount of the waste ink absorbed by the absorbing body 34 is changed (varied) due to the surrounding environment condition (temperature, humidity, etc.) and thus is not constant. Since the amount of the absorbed waste ink estimated by the waste ink absorb amount estimating section 111 is, consequently, not extremely precise, it is preferable that the detection result of the waste ink detection sensor 35 is used to judge the full liquid state of the absorbing body 34, as much as possible.

Accordingly, when performing the suction purge (S10), in a case that the waste ink inflowed into the waste ink recovery device 19 is detected to be an ink having the conductivity of not less than the predetermined value (first liquid) which can be detected by the ink kind detection sensor 31 (S11), the full liquid judging section 112 enters into the mode of judging the full liquid state of the absorbing body 34 based on the detection result of the waste ink detection sensor 35 (M1: waste ink detection sensor mode). Namely, it is judged that the absorbing body 34 is in the full liquid state when it is detected by the waste ink detection sensor 35 that the waste ink arrives at the full liquid detection position A.

On the other hand, in a case that the waste ink, flowing into the waste ink recovery device 19, is detected to be an ink having the conductivity of less than the predetermined value (second liquid) regarding which there is a fear that the waste ink detection sensor 35 might not be able to detect the ink, the full liquid judging section 112 enters into the mode of judging the full liquid state of the absorbing body 34 based on the amount of the absorbed waste ink estimated by the waste ink absorb amount estimating section 111 (waste ink absorb amount estimating mode: M2). Namely, it is judged that the absorbing body 34 is in the full liquid state when the amount of the absorbed waste ink estimated by the waste ink absorb amount estimating section 111 arrives at the limit absorb amount which has been previously set. Since the precision of presumption by the waste ink absorb amount estimating section 111 is not extremely high as described above, the limit absorb amount is set to be a value with a considerable allowance (reserve, margin) by adding a predetermined margin to a limit absorb amount determined as the designed value. When the full liquid judging section 112 judges that the absorbing body 34 is in the full liquid state, the full liquid judging section 112 transmits a full liquid detection signal to the PC 201 connected to the ink-jet printer 1, to thereby notify the user that it is the time for the absorbing body 34 of the waste ink recovery device 19 to be exchanged.

In a case that the ink kind detection sensor 31 detects even only once that the ink having a low conductivity, regarding which there is a fear that the waste ink detection sensor 35 might not be able to detect the ink, is used in the ink-jet recording head 3, the full liquid judging section 112 makes all judgments thereafter, as to whether or not the absorbing body 34 is in the full liquid state, based on the amount of the waste liquid estimated by the waste ink absorb amount estimating section 111. By doing so, it is possible to assuredly prevent such a situation that the detection of full liquid state becomes impossible due to usage of the ink having the low conductivity.

In such a manner, in a case that the ink used in the ink-jet head 3 is the ink which can be detected by the waste ink detection sensor 35, it is possible to detect the full liquid state of the absorbing body 34 (whether or not the absorbing body 34 is in the full liquid state) highly precisely by using the detection result of the waste ink detection sensor 35. On the other hand, even in a case that an ink which cannot be detected by the waste ink detection sensor 35 is used, it is possible to detect the full liquid state of the absorbing body 34, without any overlooking or detection failure, by using the estimated value by the waste ink absorb estimating section 111 and consequently to prevent the waste liquid from overflowing from the waste ink case 33.

Further, as described above, since the waste ink detection sensor 35 can detect the full liquid state of the absorbing body 34 before the absorbing body 34 is in a complete full liquid state, it is possible to assuredly prevent from the waste liquid from overflowing from the waste ink case 33 even in a case that the absorbing body 34 cannot be exchanged immediately after the waste ink detection sensor 35 detects the full liquid state of the absorbing body 34.

Next, modifications in which various modifications are made in the above-described embodiment will be described below. However, same reference numerals are assigned to elements or components having the same structure as those in the embodiment, and the description of such elements or components is omitted.

In the above-described embodiment, although the ink kind detection sensor 31 detects the conductivity of the ink by obtaining the electric current value between the electrodes, it is allowable to detect the kind of the ink by determining the resistivity between the electrodes from the electric current value. In this case, the ink kind detection sensor 31 transmits a signal indicating that the waste ink is the first liquid to the full liquid judging section 112 when the resistivity between the electrodes is lower than a previously set value, and the ink kind detection sensor 31 transmits a signal indicating that the waste ink is the second liquid to the full liquid judging section 112 when the resistivity between the electrodes is higher than the previously set value. Further, in this case, the waste ink detection sensor 35 may also perform the detection regarding the waste ink by obtaining the resistivity between the electrodes from the electric current value, in a similar manner as the ink kind detection sensor 31.

Furthermore, in the above-described embodiment, the ink kind detection sensor 31 detects the kind of the waste ink in a case that the suction purge is performed for the ink-jet head 3. However, it is also allowable to detect the kind of the ink in a case that the flushing is performed, instead of the suction purge. In such a case, it is possible to detect the kind of the ink with respect to each of the color inks when the flushing control section 109 controls as to which color of the liquid (ink) is to be jetted.

Figure 5:
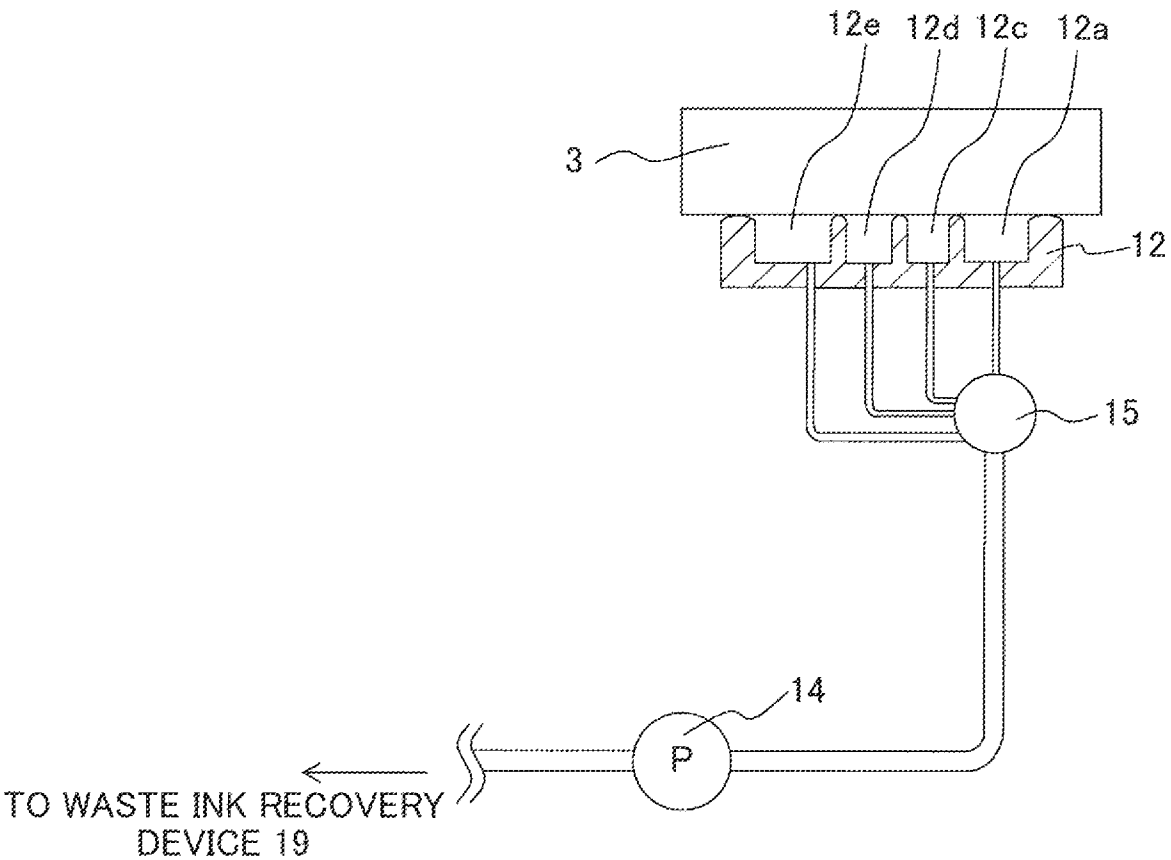
FIG. 5 is an explanatory diagram of detection of the kind of liquid in a suction purge for each of plurality of colors, according to a modification.

Moreover, in the above-described embodiment, the suction purge is performed separately for the black ink and the three color inks other than the black ink. In a case that the detection of the kind of the ink is desired to be performed separately for each of the three color inks, it is configured, as shown in FIG. 5, to provide partition plates in the cap 12 so that cap portions 12*c*, 12*d* and 12*e* each of which corresponds to the nozzles 45 of one of the three color inks are defined, and that a selection can be possible as to which one of the cap portions is made to be communicated with the suction pump 14 by the switching device 15. In a case that the suction purge control section 108 performs the suction purge for each of the color inks, it is possible to detect the kind of the ink for each of the three color inks by the ink kind detection sensor 31. By providing such a configuration, even in a case that, for example, only one color ink, among the color inks, is detected to be an ink which cannot be detected by the waste ink detection sensor 35 (second liquid) and if the three color inks are mixed to be a mixed ink which can be detected by the waste ink detection sensor 35 (first liquid), it is possible to continue the detection by the waste ink detecting sensor 35. On the contrary, in a case that there is no need to detect the kind of the ink for each of the colors of the inks, it is allowable that any partition (partition wall, partition plate, etc.) is not provided on the cap 12, that configuration is provided so as to perform the suction purge for the four color inks at the same time, and that the conductivity of a waste ink in which the four color inks are mixed is measured.

Further, it is not necessarily indispensable that a position at which the ink kind detection sensor 31 is arranged is between the member receiving the waste ink discharged from the ink-jet head 3 (the cap 12, the flushing receiving member 13) and the waste ink recovery device 19; and it is allowable to arrange the ink kind detection sensor 31 at any position provided that the kind of the ink used in the ink jet head 3 can be detected. For example, as shown in FIG. 6, the ink kind detection sensor 31 may be arranged in an ink flow passage inside a holder 10 at which the ink cartridges 6 of the respective color inks are arranged; or the ink kind detection sensor 31 may be arranged at the ink-jet head 3, the sub-tank 4 (sub-tanks 4*a* to 4*d*), etc.

Figure 7B:
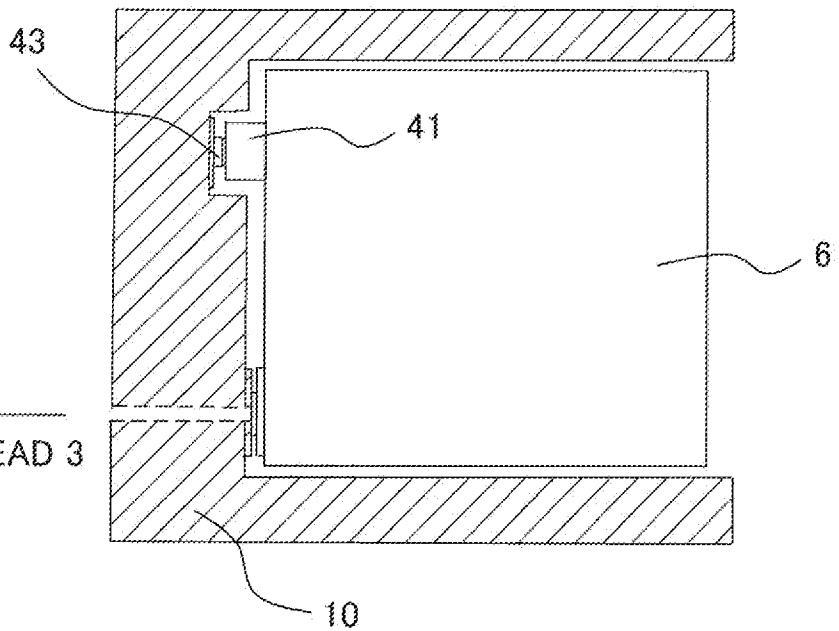
FIGS. 7A and 7B are explanatory diagrams of detection of a first liquid with an identifier detection sensor, according to still another modification.
Figure 7A:
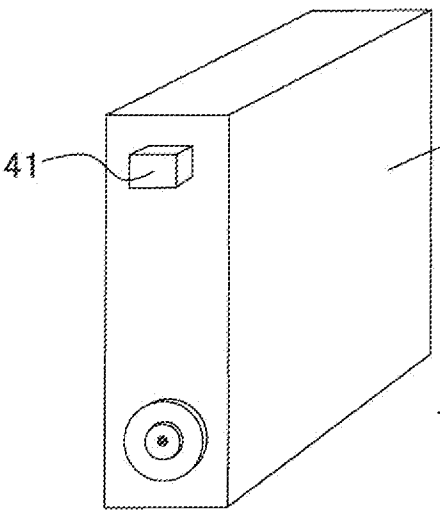

As another method for detecting the kind of the ink, other than the method with the ink kind detection sensor 31, it is allowable, for example, that the ink cartridge 6 is provided with an identifier 41 indicating that an ink inside the cartridge 6 is an ink (first liquid) that can be detected by the waste ink detection sensor 35. For example, as shown in FIGS. 7A, 7B, a protrusion (as the identifier 41) may be provided on the ink cartridge 6 at an end portion in an attachment direction in which the ink cartridge 6 is attached to the holder 10 (front direction in FIG. 7A), and the holder 10 may be provided with an identifier detection sensor 43 which detects the identifier 41. In this case, when the ink cartridge 6 is attached to the holder 10, the identifier 41 is detected by the identifier detection sensor 43 to thereby cause a signal indicating that the ink inside the cartridge 6 is the first liquid to be inputted to the full liquid judging section 112 of the controller 101. With this, it is possible to easily judge whether or not the ink inside the ink cartridge is the first liquid.

Figure 6:
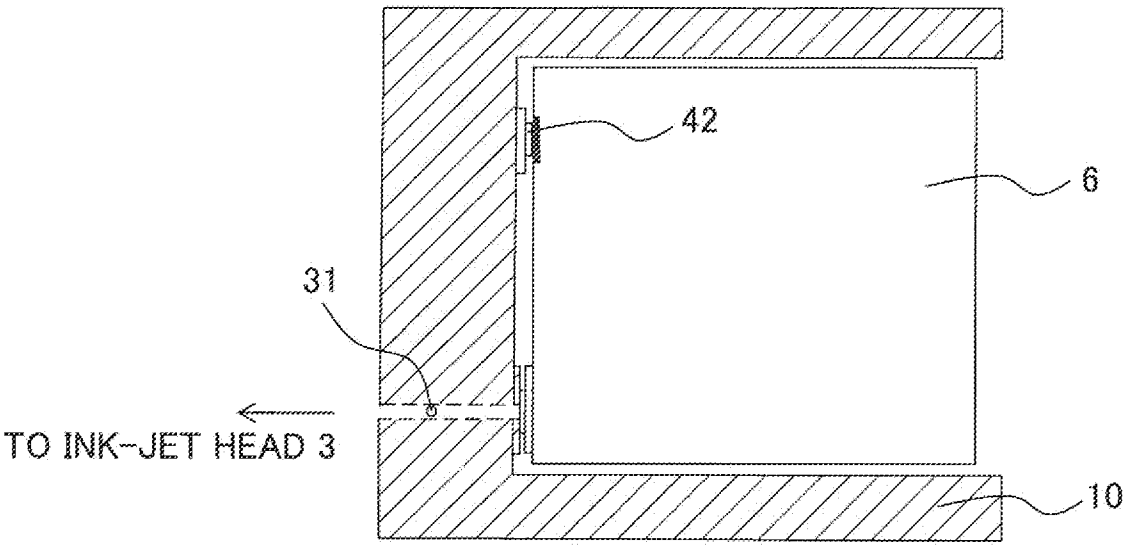
FIG. 6 is an explanatory diagram of detection of a first liquid by an ink kind detection sensor arranged between an ink cartridge attachment section and a head, according to another modification.

Further, it is allowable that, as in the ink cartridge 6 and an ink cartridge attachment section of the holder 10 to which the ink cartridge 6 is attached shown in FIG. 6, the holder 10 is provided with an attachment/detachment detection sensor 42 detecting the attachment/detachment of the ink cartridge 6, and the ink kind detection sensor 31 for detecting the kind of the ink of the ink cartridge 6. A signal of the attachment/detachment detection sensor 42 is inputted to the controller 101, and the controller 101 counts as to how many times each of the ink cartridges 6 is attached/detached. Further, it is also allowable to change the operation of the full liquid judging section 112 by utilizing the situation that the attachment/detachment number of times of each of the ink cartridges 6 can be grasped. Namely, even when an ink having a low conductivity (low-conductivity ink) is used, there is a case that the low-conductivity ink is mixed with an ink having a high conductivity (high-conductivity ink) inside the absorbing body 34 and can be detected with the waste ink detection sensor 35 if the usage amount of the low-conductivity ink is small. In view of this, even if it is detected that an ink cartridge 6 storing an ink of which conductivity is less than the predetermined value (second liquid) is attached, in a case that the number of times of the attachment/detachment of the ink cartridge 6 storing the low-conductivity ink (second liquid) is small (not more than a constant ratio) as compared with the number of times of the attachment/detachment of an ink cartridge 6 storing the high-conductivity ink, it is also allowable that the full liquid state is detected from the detection result of the waste ink detection sensor 35. By providing such a configuration, even if an ink cartridge 6 storing the low-conductivity ink (second liquid) is used, in a case that a mixed waste ink in which the high-conductivity ink and the low-conductivity ink (second liquid) are mixed can be detected by the waste ink detection sensor 35, it is possible to detect the full liquid state of the absorbing body 34 highly precisely by the waste ink detection sensor 35.

Figure 8A:
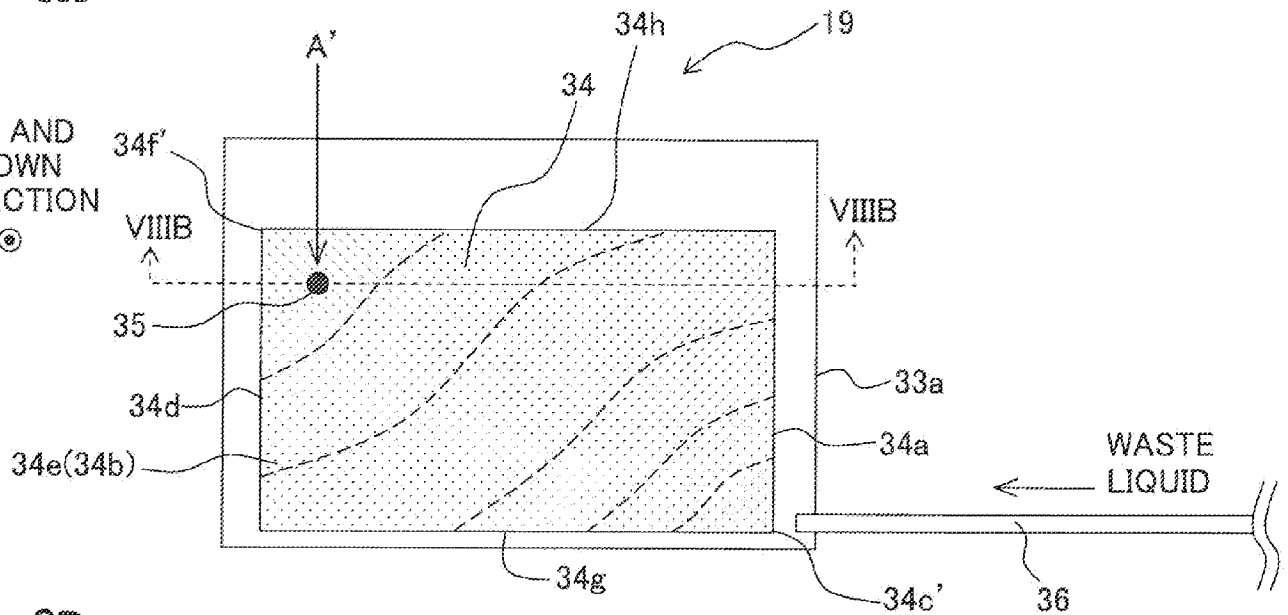
FIGS. 8A and 8B are diagrams showing a modification of the waste ink recovery device.
Figure 8B:
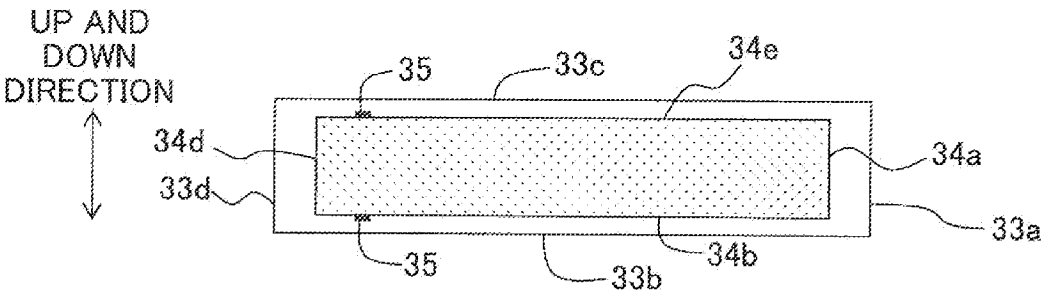

In the above-described embodiment, the electrodes of the waste ink detecting sensor 35 are arranged in the pair of mutually facing side surfaces 34*g*, 34*h*, respectively, in the vicinity of the corner portion 34*f* of the absorbing body 34. However, the arrangement position for the electrodes is not limited to this. For example, as shown in FIGS. 8A and 8B, it is allowable that the waste ink case 33 and the absorbing body 34 both have a shape of a rectangular parallelepiped which is thin in the up and down direction, and that a tube 36 communicating with the cap 12 and the flushing receiving member 13 is connected to a portion, of the absorbing body 34, in the vicinity of a corner portion 34*c*' defined by side surfaces 34*a*, 34*g* of the absorbing body 34. In this case also, the waste ink flowing from the tube 36 into the waste ink case 33 is absorbed by the absorbing body 34 from the corner portion 34*c*' of the absorbing body 34, and the waste ink permeates or infiltrates in the absorbing body 34 radially from the corner portion 34*c*' as the permeation/infiltration center. At this time, a corner portion 34*f* defined by a side surface 34*d* (side surface facing the side surface 34*a* of the absorbing body 34) and a side surface 34*h* of the absorbing body 34, is assumed as a portion at which the waste ink arrives lastly. Accordingly, the waste ink detection sensor 35 may have a pair of electrodes arranged in an upper surface 34*e* and a bottom surface 34*b*, respectively, of the absorbing body 34, at a detection position A' located in the vicinity of the corner portion 34*f*.

The embodiment and the modifications thereof as described above are each an example that the present teaching is applied to an ink-jet printer. However, in a liquid droplet jetting apparatus used for a purpose other than the image recording, an absorbing body recovering a liquid discharged from a liquid droplet jetting head would be also necessary. Accordingly, the present teaching can be applied to liquid droplet jetting apparatuses used in various fields.

What is claimed is:

1. A liquid droplet jetting apparatus which jets a liquid droplet of a liquid, comprising:

a liquid droplet jetting head which has a nozzle formed therein and which jets the liquid droplet of the liquid from the nozzle;

a liquid kind detecting section which detects whether the liquid, used in the liquid droplet jetting head, is a first liquid having a conductivity of not less than a predetermined value or a second liquid having a conductivity of less than the predetermined value;

a discharge mechanism which discharges the liquid inside the liquid droplet jetting head from the liquid droplet jetting head;

a waste liquid recovery device which recovers the liquid discharged by the discharge mechanism, the waste liquid recovery device including:

a waste liquid case;

an absorbing body accommodated in the waste liquid case; and a waste liquid detection mechanism which measures an electric current value in the absorbing body at a predetermined full-liquid detection position when a predetermined voltage is applied, and which detects whether or not the liquid arrives at the full-liquid detection position of the absorbing body based on the measured electric current value;

a waste liquid absorb amount estimating section which estimates an amount of the waste liquid, absorbed in the absorbing body, based on a value of an estimated amount of the waste liquid generated by one discharge operation of the discharge mechanism and the number of times of the discharge operations performed by the discharge mechanism; and a full liquid judging section which judges whether or not the absorbing body is in a full liquid state;

wherein the full liquid judging section judges whether or not the absorbing body is in the full liquid state based on a detection result of the waste liquid detection mechanism, under a condition that the liquid kind detecting section detects that the liquid is the first liquid having the conductivity of not less than the predetermined value; and wherein the full liquid judging section judges whether or not the absorbing body is in the full liquid state based on the amount of the waste liquid estimated by the waste liquid absorb amount estimating section, under a condition that the liquid kind detecting section detects that the liquid is the second liquid having the conductivity of less than the predetermined value.

2. The liquid droplet jetting apparatus according to claim 1, further comprising:

a cartridge attachment section to which a liquid cartridge, storing the liquid therein, is detachably attached and which is connected to the liquid droplet jetting head;

wherein the liquid cartridge storing the first liquid is provided with an identifier showing that the liquid stored in the liquid cartridge is the first liquid; and the liquid kind detecting section detects whether or not the identifier is provided on the liquid cartridge attached to the cartridge attachment section.

3. The liquid droplet jetting apparatus according to claim 1;

wherein the liquid kind detecting section detects a conductivity of the liquid which is used in the liquid droplet jetting head.

4. The liquid droplet jetting apparatus according to claim 3;

wherein the discharge mechanism has a liquid receiving member which receives the liquid discharged from the nozzle of the liquid droplet jetting head;

the liquid receiving member is connected to the waste liquid recovery device, and the liquid kind detecting section is arranged between the liquid receiving member and the waste liquid recovery device.

5. The liquid droplet jetting apparatus according to claim 4;

wherein the liquid includes a plurality of kinds of liquids;

wherein the nozzle is provided as a plurality of kinds of nozzles in the liquid droplet jetting head, and the plurality of kinds of nozzles jet the plurality of kinds of liquids, respectively;

wherein the discharge mechanism individually discharges, toward the liquid receiving member, each of the plurality of kinds of liquids from one of the plurality of kinds of nozzles; and wherein the liquid kind detecting section detects whether or not each of the plurality of kinds of liquids, individually discharged from one of the plurality of kinds of nozzles toward the liquid receiving member, is the first liquid.

6. The liquid droplet jetting apparatus according to claim 4;

wherein the discharge mechanism has:

a cap which serves as the liquid receiving member and which makes contact with the liquid droplet jetting head to cover the nozzle; and a suction mechanism which is arranged between the cap and the waste liquid recovery device;

wherein the discharge mechanism is configured to perform a suction purge in which inside of the cap is depressurized in a state that the cap covers the nozzle so as to discharge the liquid; and wherein the liquid kind detecting section detects a conductivity of the liquid flowing from the cap to the waste liquid recovery device under a condition that the suction purge is performed.

7. The liquid droplet jetting apparatus according to claim 6;

wherein the liquid kind detecting section is arranged at the suction pump and the waste liquid recovery device.

8. The liquid droplet jetting apparatus according to claim 4;

wherein the discharge mechanism includes a liquid-droplet jetting actuator which applies pressure to the liquid inside the liquid droplet jetting head to cause the liquid to be jetted from the nozzle, and the discharge mechanism is configured to perform a flushing in which the liquid-droplet jetting actuator causes the liquid droplet to be jetted from the nozzle toward the liquid receiving member; and wherein the liquid kind detecting section detects a conductivity of the liquid flowing from the liquid receiving member to the waste liquid recovery device under a condition that the flushing is performed.

9. The liquid droplet jetting apparatus according to claim 3, further comprising:

a cartridge attachment section to which a liquid cartridge, storing the liquid therein, is detachably attached and which is connected to the liquid droplet jetting head;

wherein the liquid kind detecting section is arranged between the cartridge attachment section and the liquid droplet jetting head.

10. The liquid droplet jetting apparatus according to claim 1;

wherein after the liquid kind detecting section has detected that the liquid is the second liquid, the full liquid judging section makes judgment, as to whether or not the absorbing body is in the full liquid state, based on the amount of the waste liquid estimated by the waste liquid absorb amount estimating section.

11. The liquid droplet jetting apparatus according to claim 1;

wherein the absorbing body is exchangeably accommodated in the waste liquid case; and wherein detection by the waste liquid detection mechanism is performed in parallel with presumption by the waste liquid absorb amount estimating section immediately after start of usage of the liquid droplet jetting apparatus or immediately after exchange of the absorbing body.

12. The liquid droplet jetting apparatus according to claim 1, further comprising:

a cartridge attachment section to which a first liquid cartridge storing the first liquid therein, and a second liquid cartridge storing the second liquid therein, are detachable attached, and which is connected to the liquid droplet jetting head;

a first attachment-detachment detection sensor which is provided for the cartridge attachment section, and which detects at least one of attachment and detachment of the first liquid cartridge with respect to the cartridge attachment section; and a second attachment-detachment detection sensor which is provided for the cartridge attachment section, and which detects at least one of attachment and detachment of the second liquid cartridge with respect to the cartridge attachment section;

wherein the full liquid judging section judges whether or not the absorbing body is in the full liquid state based on a detection result of the waste liquid detection mechanism, under a condition that the number of times of at least one of attachment and detachment of the second liquid cartridge detected by the second attachment-detachment detection sensor is small as compared with the number of times of at least one of attachment and detachment of the first liquid cartridge detected by the first attachment-detachment detection sensor.

* * * * *